United States Patent [19]

Combs

[11] 4,407,425

[45] Oct. 4, 1983

[54] CONTAINER CLOSURE LID INCLUDING DRINKING SPOUT MEANS

[76] Inventor: Marvin Combs, 2327 Mayhew Dr., Indianapolis, Ind. 46227

[21] Appl. No.: 350,754

[22] Filed: Feb. 22, 1982

[51] Int. Cl.[3] ..... B65D 17/32; B65D 47/10; B65D 47/32

[52] U.S. Cl. ..... 220/269; 220/85 SP; 220/90.2; 220/366; 222/529; 222/541; 229/7 S

[58] Field of Search ..... 229/7 S; 220/90.4, 90.2, 220/90.6, 85 SP, 269, 270, 366; 222/541, 527, 528, 529, 530, 533, 534, 83, 569, 570

[56] References Cited

U.S. PATENT DOCUMENTS

| | | | |
|---|---|---|---|
| 1,459,443 | 6/1923 | Davis | 222/528 |
| 1,908,444 | 5/1933 | Praechtl | 222/528 |
| 2,800,265 | 7/1957 | Pugh, Sr. | 229/7 S |
| 2,821,332 | 1/1958 | Sherbondy | 222/569 |
| 2,832,515 | 4/1958 | Barradas | 222/541 X |
| 3,240,415 | 3/1966 | Pugh, Sr. | 229/7 S |
| 3,298,577 | 1/1967 | Chlystun | 229/7 S X |
| 3,325,043 | 6/1967 | Henchert et al. | 220/270 |
| 3,395,839 | 8/1968 | Vercillo | 222/541 X |
| 3,401,821 | 9/1968 | Bozek | 220/270 |
| 3,730,380 | 5/1973 | Silver | 220/269 |
| 4,216,880 | 8/1980 | Drelichowski | 222/541 X |

*Primary Examiner*—Allan N. Shoap

*Attorney, Agent, or Firm*—Woodard, Weikart, Emhardt & Naughton

[57] ABSTRACT

A closure lid for beverage containers and the like includes a raised boss portion which is integral with the lid and arranged into a generally curved area and a generally rectangular area. This closure lid further includes a flexible spout member arranged with a base portion and a resilient drinking spout and it is secured within the boss portion of the lid. The base portion of the flexible spout member includes a smaller peripheral edge portion and a larger, upper peripheral edge portion combining to form a lip. The enclosing boss portion is cooperatively contoured so as to rigidly clamp this lip thereby holding the flexible spout member in a fixed orientation relative to the boss portion. The boss portion comprises a closure strip defined by score lines and which is separable from the boss portion by means of a pull ring. Disposed beneath this closure strip is the folded resilient drinking spout portion of the spout member. Upon separating the closure strip from the boss portion, the drinking spout is permitted to freely pivot upwardly and outwardly to a substantially normal orientation relative to the remainder of the closure lid. This upward orientation constitutes an open condition, thus permitting the contents of the container to be withdrawn by the user through this drinking spout.

6 Claims, 5 Drawing Figures

CONTAINER CLOSURE LID INCLUDING DRINKING SPOUT MEANS

BACKGROUND OF THE INVENTION

The present invention relates in general to container closures and in particular to pull-ring type closures which are incorporated into the container lid.

For a number of years, carbonated and alcoholic beverages have been sold in nonreturnable containers such as aluminum and steel cans. Prior to the introduction of such cans, these types of beverages were sold in glass bottles whose neck and outlet designs were such so as to offer a form of drinking spout to the consumer. Unfortunately, the design of cans does not permit a similar neck and outlet construction. Consequently, a revised drinking procedure resulted when such cans were introduced.

The sealing of the can lids to the can body, the desire to have a compact design, in order to minimize the amount of material required, and the interest in providing easy packaging all contributed to the cylindrical, flat-end construction of such cans. A changeover from bottles to cans also necessitated a revised opening procedure. While the can opener could be used in both instances either to pry off the cap of a bottle or to puncture the end lid of a can, consumer convenience ultimately dictated some type of manually openable design for both types of containers that would not require a can opener or other instrument. In the case of the bottles, a twist-off cap was provided and in the case of the cans, the result was the pull-tab concept wherein a strip of metal defined by score lines is removed by pulling on a ring riveted to the strip. What was left in the case of the cans was an opening defined by exposed metal edges that the consumer would have to press his lips against these edges while tilting the can in order to drink from the can. With the bottle design, not only was the end portion of the bottle where the consumer would have to press his lips covered by the cap and therefore maintained in a sanitary condition, but the consumer still had the comfort and convenience of a drinking spout.

The method of drinking that requires the consumer to press his lips against exposed metal edges not only poses a danger of cut lips and tongue, but it is unsanitary since the lid end of the can is not covered or otherwise kept clean. An additional concern to this type of pull-tab can design was the disposal of the removed ring and metal strip that was pulled from the end lid in order to open the container. These "tabs" have been a concern in that they litter beaches and parks. Further, they are frequently stepped on, resulting in cuts to feet and toes. This latter problem has been solved to some extent by the push-top cans wherein a scored strip of metal is popped up and then pushed into the opening through which the contents are obtained. This method does not solve the concerns about the drinking procedure being unsanitary nor does it reduce the risk of cut lips and tongues. In fact, this method is even less sanitary because the tab is pushed into the contents of the can.

To date, nothing has been done to eliminate the latter two concerns. Regardless of the type of pull-ring or push-tab design, the consumer must push his lips up against the lid end and against the exposed metal edges of the created opening. Consequently, it would be an improvement to the design of such beverage containers to provide a drinking spout that would be sanitary and safe. Further, such an improvement would be even more valuable if it is compatible with the present fabrication procedure of such can lids and bodies so as to preclude, to the maximum extent possible, any need to redesign the associated production tooling. The present invention provides such an improvement in a novel and unobvious manner that is fully disclosed herein.

SUMMARY OF THE INVENTION

A closure lid for beverage containers and the like according to one embodiment of the present invention comprises a boss portion integral with the lid, a closure strip disposed as part of the boss portion and being manually separable from the boss portion, and a flexible spout member having a base portion secured within the boss portion and a resilient drinking spout portion folded over beneath the closure strip in a closed condition and upwardly pivotally movable to an open condition when the closure strip is separated from the boss portion.

One object of the present invention is to provide an improved container closure lid for beverage containers.

Related objects and advantages of the present invention will be apparent from the following description.

DESCRIPTION OF THE PREFERRED EMBODIMENT

Figure 1:
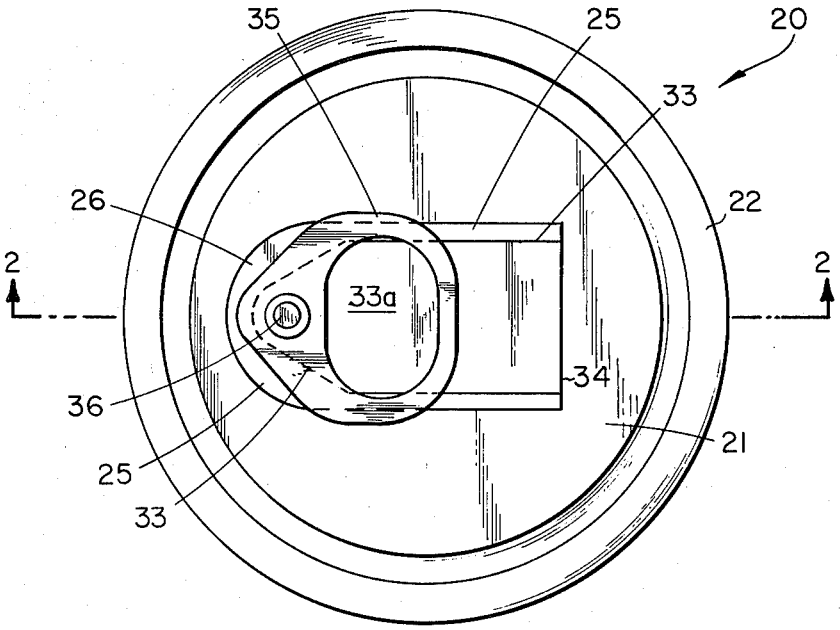
FIG. 1 is a top plan view of a closure lid for beverage containers according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
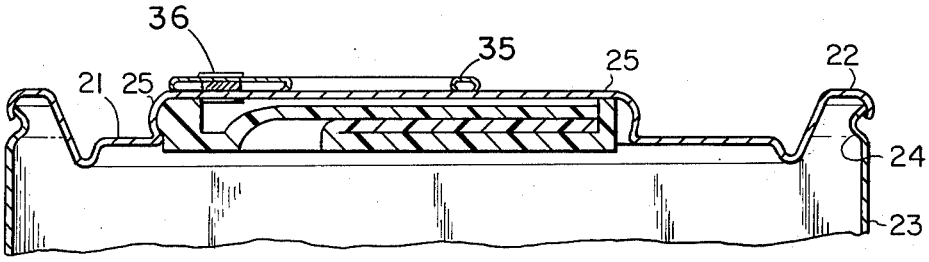
FIG. 2 is a side elevation view in full section of the FIG. 1 closure lid in a closed condition.

Referring to FIGS. 1 and 2, there is illustrated a closure lid 20 which includes a top surface 21 and an outer edge 22. While the particular closure lid design that will be disclosed herein may be applicable to a wide variety of container designs, the exemplary embodiment discloses the use of the invented closure lid as part of an aluminum can similar to that used for carbonated and alcoholic beverages.

The can body 23 is disclosed partially and generally in FIG. 2 and this can body has a formed upper lip 24 which is compatible with the design of outer edge 22 such that upper lip 24 and outer edge 22 may be securely crimped together in a sealed fashion by automated processing equipment. Such sealing is important in order to pressure the integrity of the contents of the container.

Disposed somewhat centrally across top surface 21 is a raised boss portion 25. This boss portion includes a part-circular (curved) area 26 and integral therewith a generally rectangular area 27. The resultant overall shape is somewhat oblong in nature being curved at one end and straight at the opposite end.

Disposed beneath boss portion 25 such that it is located on the interior of the container is a flexible spout member 30 which includes a somewhat oblong base portion 31 and a resilient drinking spout 32. Although the precise geometry of the boss portion and the flexible spout member may vary from design variation to design variation, it is appropriate to describe the base portion 31 as having an oblong shape that approximates the previously described oblong shape of raised boss portion 25. In the arrangement of FIG. 2, the container is in a closed condition and the resilient drinking spout 32 is folded over so that a majority of its length is substantially parallel with the top surface of base portion 31 and rectangular area 27 of boss portion 25. Further, the outer periphery of boss portion 25 is shaped and contoured so as to receive the outer periphery of base portion 31 in a manner that rigidly secures the base portion within the boss portion.

Included as part of boss portion 25 is a score line 33, a first portion of which begins at end 34 and extends in a direction parallel to one of the straight sides of the boss portion before turning inwardly prior to reaching the opposite end. The score line continues toward the opposite straight side in a direction that approximates the path of the first portion.

Since the two score line portions are disposed inwardly of the outer periphery of the boss portion, an internal area 33*a* is defined which is in fact a strip of metal that is joined to the top surface 21 at end 34. Riveted to one end of area 33*a* is a pull ring 35. By manually pulling up on this pull ring, downward pressure is exerted on the opposite side of rivet 36 which separates that portion of area 33*a* which is adjacent the rivet from the surrounding boss portion. Continued upward and longitudinal pulling on ring 35 separates the metal strip (area 33*a*) from the straight sides until end 34 is reached. At this point, the separated strip of metal is pulled over edge 22 and pressed against the side of the container (see FIG. 3). While FIG. 2 represents the container in a closed condition, FIG. 3 represents the container in an open condition.

Figure 3:
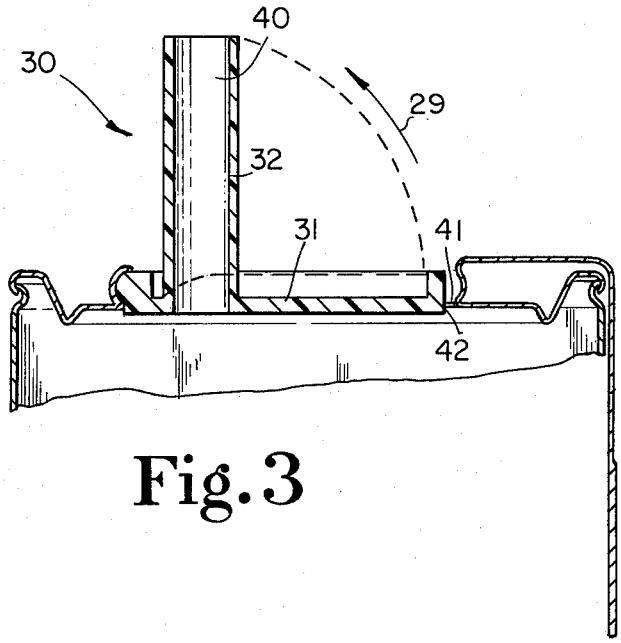
FIG. 3 is a side elevation view in full section of the FIG. 1 closure lid in an open condition.

Although it is possible for the strip of metal (area 33*a*) to be completely removed by bending it back and forth at end 34, as is illustrated in FIG. 3, the strip of metal and the pull ring 35 remain as part of the closure lid and container by designing end 34 so that it is not severable via a score line. In either case, when the rectangular area is pulled free of the top surface of the closure lid, an opening is created and this opening has a size sufficient to permit resilient drinking spout 32 to pivot upwardly in the direction of arrow 39. In this final (open) position, the spout is oriented in a substantially normal manner to top surface 21 and to base portion 31. In this orientation, central passageway 40, which extends completely through flexible spout member 30, establishes an open flow path from the interior of the container to the exterior. It is thus resilient drinking spout 32 which is used by the consumer to extract the contacts of the container in a manner very similar to drinking from the spout or neck of a glass bottle.

Since the base portion 31 is slightly shorter than boss portion 25, a small vent area 41 is left adjacent end 34 between end 34 and end 42. Otherwise, the opening created by removal of area 33*a* is completely closed by base portion 31. As has been mentioned, base portion is held in position by the overlapping of its edges by boss portion 25 and this is true around the entire periphery of the base portion except for end 42.

Figure 4:
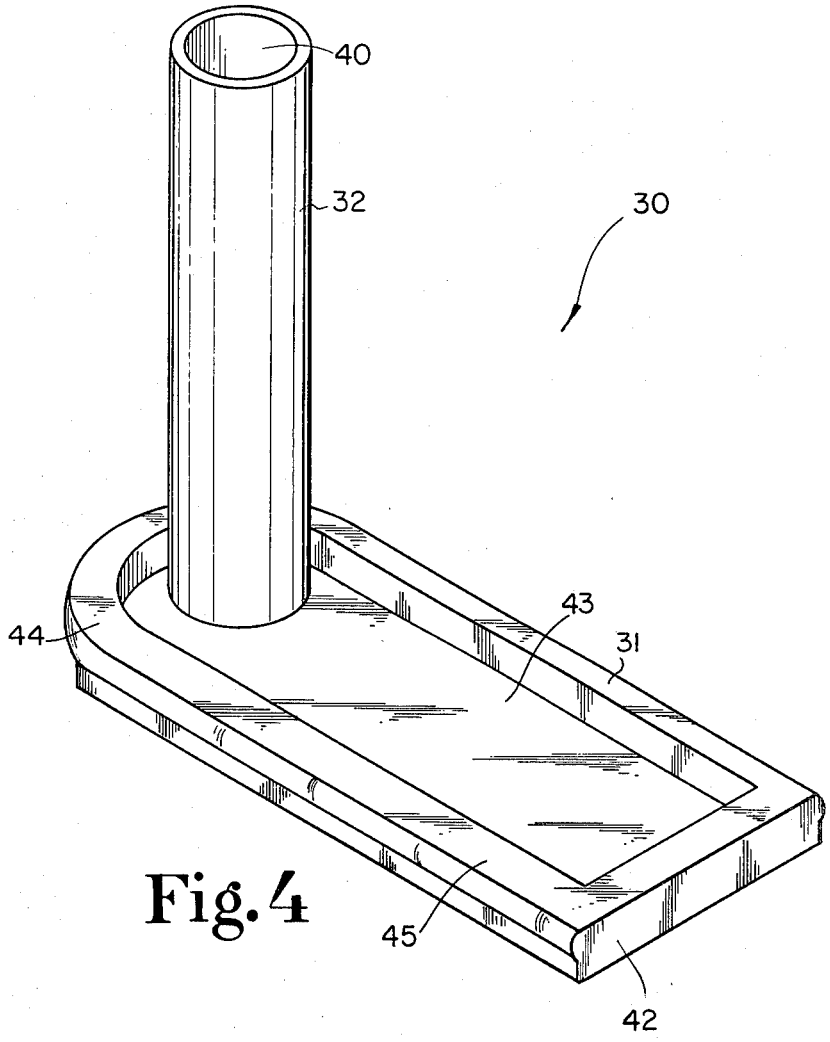
FIG. 4 is a perspective view of a flexible spout member comprising a portion of the FIG. 1 closure lid.

It is the resilient nature of drinking spout 32 that enables it to spring or flip upwardly upon removal of the metal strip that comprises area 33*a*. It is also known that a suitable material for this resilient drinking spout is latex and the entire flexible spout member 30 is molded as a single, integral member of this material. Flexible spout member 30 is illustrated in greater detail in FIG. 4 wherein it is shown that base portion 31 has a recessed area 43 which is provided in order to receive the drinking spout when in a folded and closed orientation. This figure also illustrates that the base portion is arranged into a curved area 44 and a rectangular area 45. In order to enable spout 32 to be used, its length is more than one inch so that it extends sufficiently above the surface of the lid.

Figure 5:
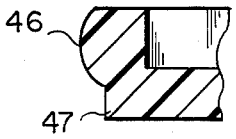
FIG. 5 is a partial front elevation view of the outer periphery of the FIG. 4 spout member.

Referring to FIG. 5, the outer periphery of base portion 31 is configured with a larger top edge 46 and a smaller edge 47 below the top edge and recessed inwardly therefrom. Consequently, by contouring the boss portion to conform to this edge shape, not only does the boss portion preclude the spout member from falling out when the ring is pulled, but it also precludes the spout member from falling into the container contents. This construction concept assures that the flexible spout member will not fall into the interior of the container once the rectangular strip is removed and the spout flipped to a vertical orientation.

The use of the invention should be clear at this point. The securing of the spout member to the lid by use of the boss portion enables the drinking spout to flip up automatically upon pulling the strip of metal over to end 34. When in a closed condition, the container is sealed and the contents remain sanitary. The drinking spout is not exposed and its flexible nature precludes cut lips and tongue. The contents are unable to slosh and spill since the only opening other than the drinking spout is the small vent area. Thus, while the invention clearly solves the concerns about cuts and sanitary drinking, containers fitted with the disclosed lid design are suitable for travel in that risk of spills are minimized.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A closure lid for carbonated beverage containers which comprises:

a boss portion unitary with said lid and coterminous with a pour opening disposed in said lid;

a closure strip disposed inwardly of the outer periphery of said boss portion and disposed as part of said boss portion and manually separable from said boss portion;

a flexible spout member having a unitary base portion having an outer upwardly projecting periphery which defines a spout receiving recess, a portion of said outer periphery of said base portion being secured within said boss portion; and said flexible spout member further having unitary therewith a cylindrical resilient drinking spout portion folded over beneath said closure strip and received within said spout receiving recess in a closed condition and said resilient spout springing upwardly from said closed condition to an open condition when said closure strip is separated from said boss portion, said closure strip and said drinking spout being spaced apart in said open condition allowing oral contact with just said drinking spout, a vent being disposed in said pour opening spaced from said spout receiving recess.

2. The closure lid of claim 1 wherein the upwardly projecting outer periphery of the base portion of said spout member has an outwardly extending lip and said boss portion is contoured in a cooperating manner so as to clamp about said lip.

3. The closure lid of claim 1 wherein said closure lid has an under surface facing the contents of the container;

said base portion having an under surface a portion of which is exposed to the contents of said container when said base portion is secured in said boss; and said base portion having an opening in said base portion under surface, said opening being in flow communication with said drinking spout, and said opening being in a plane substantially flush with a portion of said under side of said closure lid.

4. The closure lid of claim 1 which further includes a pull ring secured to said closure strip, said closure strip being defined by score lines; and said score lines retaining said closure strip to said boss with a force greater than the force generated by the pressure of the carbonated beverage in said carbonated beverage container.

5. The closure lid of claim 1 wherein said vent is defined by an opening formed by one side of said base portion and said closure lid.

6. A closure lid for beverage containers which comprises:

a boss portion unitary with said lid;

a closure strip disposed as part of said boss portion and manually separable from said boss portion;

a flexible spout member having a base portion secured within said boss portion and a resilient drinking spout portion folded over beneath said closure strip in a closed condition and being upwardly and pivotally movable to an open condition when said closure strip is separated from said boss portion; and a vent opening defined by said base portion and said closure lid, said vent opening being exposed when said closure lid is in said open condition, and said vent opening being exterior of said spout member.

* * * * *